US011462866B2

(12) United States Patent
Huang

(10) Patent No.: US 11,462,866 B2
(45) Date of Patent: Oct. 4, 2022

(54) PLUG POWER CORD

(71) Applicants: Jiangmen Changshun Mechanical & Electronical Co., Ltd, Jiangmen (CN); Fangxin Huang, Guangdong (CN)

(72) Inventor: Hongye Huang, Jiangmen (CN)

(73) Assignee: Jiangmen Changshun Mechanical & Electronical Co, Ltd., Jiangmen (CN)

( * ) Notice: Subject to any disclaimer, the term of this patent is extended or adjusted under 35 U.S.C. 154(b) by 0 days.

(21) Appl. No.: 17/189,403

(22) Filed: Mar. 2, 2021

(65) Prior Publication Data

US 2021/0305756 A1 Sep. 30, 2021

(30) Foreign Application Priority Data

Mar. 24, 2020 (CN) ..... 202020389363.X

(51) Int. Cl.

| | |
|---|---|
| ***H01R 13/713*** | (2006.01) |
| ***H01R 24/28*** | (2011.01) |
| ***H01R 24/30*** | (2011.01) |
| ***H01R 103/00*** | (2006.01) |

(52) U.S. Cl.

CPC ..... *H01R 13/7137* (2013.01); *H01R 24/28* (2013.01); *H01R 24/30* (2013.01); *H01R 2103/00* (2013.01)

(58) Field of Classification Search

CPC .... H01R 13/68; H01R 13/70; H01R 13/7173; H01R 13/7137; H01R 24/28; H01R 24/30; H01R 2103/00

USPC ..... 439/620.26; 337/92, 93, 112, 113, 197, 337/269

See application file for complete search history.

(56) References Cited

U.S. PATENT DOCUMENTS

| | | | | | |
|---|---|---|---|---|---|
| 1,687,167 | A * | 10/1928 | Mann | H01R 13/6616 | 337/102 |
| 3,798,582 | A * | 3/1974 | Schwartz | H01R 13/70 | 337/92 |
| 6,100,784 | A * | 8/2000 | Hofsass | H01H 11/0056 | 337/333 |
| 7,666,033 | B1 * | 2/2010 | Fung | H01R 13/7137 | 439/620.26 |
| 2010/0167596 | A1 * | 7/2010 | Yang | H01R 13/7137 | 439/692 |
| 2015/0279596 | A1 * | 10/2015 | Chen | H01H 37/52 | 337/362 |

* cited by examiner

*Primary Examiner* — Gary F Paumen
(74) *Attorney, Agent, or Firm* — Caldwell Intellectual Property Law

(57) ABSTRACT

Disclosed is a plug power cord, which includes a plug including a main body, a live wire contact and a neutral wire contact, and a load wire. The load wire is connected with the live wire contact, and a protector is arranged between the load wire and the live wire contact, or, the load wire is connected with the neutral wire contact, and a protector is arranged between the load wire and the neutral wire contact.

19 Claims, 2 Drawing Sheets

PLUG POWER CORD

CROSS-REFERENCE TO RELATED APPLICATIONS

This application claims the benefit of priority of Application No. 202020389363.X filed on Mar. 24, 2020 and entitled "PLUG POWER CORD," the entirety of which is incorporated herein by reference.

FIELD OF THE INVENTION

The present disclosure relates to the field of household electrical appliances, and more particularly to a plug power cord.

BACKGROUND

For household appliances with a plug, if the current is too large when the plug is inserted into the power socket for use due to the excessively high voltage of the power supply or the fault of the load household appliances connected at the other end, the plug is liable to heat up and thereby causing damage to the plug. If the heat is too severe, the socket may be heated and catch fire, resulting in danger. And in existing plugs, some do not have any protection device, and some guarantee by means of adopting fuse that plug will not get overheated, but after fuse fuses, it is needed to replace with new plug, which is extremely inconvenient.

SUMMARY OF THE DISCLOSURE

According to a first embodiment of the present disclosure, a plug power cord includes a plug, the plug including a main body, a live wire contact and a neutral wire contact, a load wire, wherein the load wire is connected with at least one of the live wire contact and the neutral wire contact, and a protector, the protector arranged between the load wire and the at least one of the live wire contact and the neutral wire contact to which the load wire is connected.

The additional aspects and advantages of the present disclosure will be given in the following description, part of which will become apparent from the following description or be known through the practice of the present disclosure.

BRIEF DESCRIPTION OF THE DRAWINGS

The above and/or additional aspects and advantages of the present disclosure will become apparent and easy to understand from the description of embodiments in combination with the attached figures below, in which.

Figure 1:
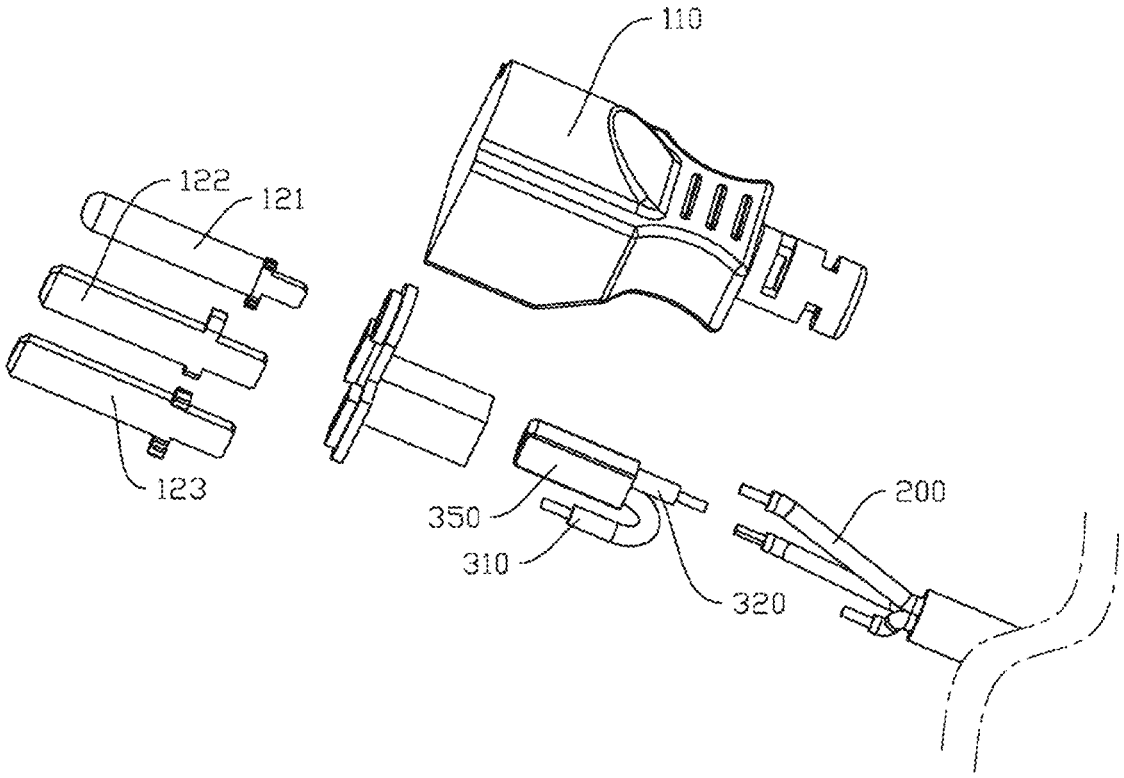
FIG. 1 is an exploded view of a plug power cord in an embodiment of the present disclosure.
Figure 2:
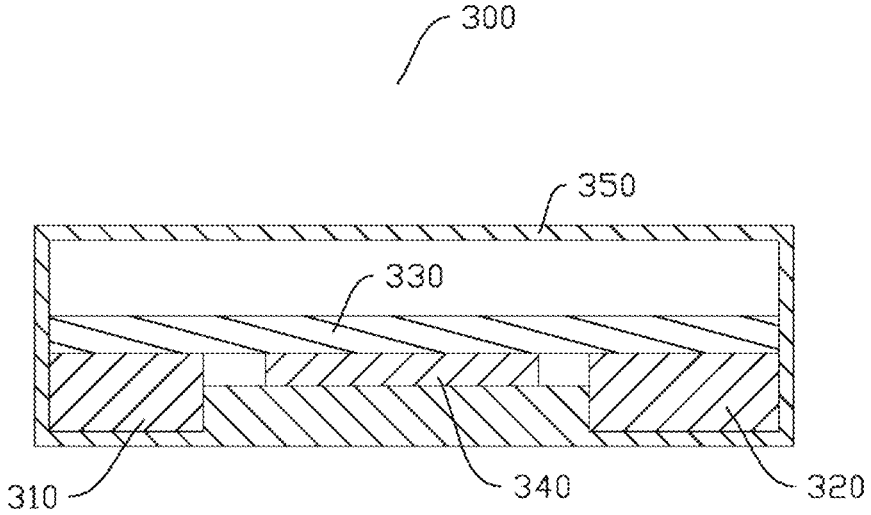
FIG. 2 is a cross-sectional view of a protector in embodiment 1 or embodiment 2 of the present disclosure.

The drawings are not necessarily to scale and may be illustrated by phantom lines, diagrammatic representations and fragmentary views. In certain instances, details that are not necessary for an understanding of the embodiments or that render other details difficult to perceive may have been omitted.

DETAILED DESCRIPTION

Embodiments of the present disclosure are described in detail below, and examples of the embodiments are shown in the attached drawings, where the same or similar reference numerals from beginning to end represent the same or similar elements or elements with the same or similar functions. The embodiments described below by referring to the attached drawings are exemplary and are only used to interpret the present disclosure, which cannot be understood as limit on the present disclosure.

In description of the present disclosure, it is understood that the location description as involved, such as up, down, forward, backward, left, right, indicating the location or position relationship based on the location or position shown in the appended drawings is only used to facilitate the description of this present disclosure and simplified description, rather than to instruct or imply that devices or components referred to must have a specific location, in a specific orientation structure and operation, which therefore cannot be interpreted as limiting the present disclosure.

In the description of the present disclosure, "several" means one or more; "a plurality of" means two or more; "more than", "less than", "exceed" and the like shall not be construed as including the number itself; "no less than", "no more than", "within" and the like shall be construed as including the number itself. If "the first" and "the second" are described, which is only for the purpose of distinguishing technical features, which cannot be understood as indicating or implying relative importance or implicitly specifying the precedence relationship or the number of the technical features as indicated.

In the description of the present disclosure, unless otherwise specified, the words such as setting, installation and connection shall be understood in a broad sense, and those skilled in the art may reasonably determine the specific meaning of the above words in the present disclosure in combination with the specific content of the technical scheme.

The present disclosure is designed to solve at least one of the technical problems existing in the existing technology. To this end, the present disclosure proposes a plug power cord, which can protect the plug, reduce waste and reduce the use-cost. Plug power cord of the present disclosure at least has the following beneficial effects: When the overload is too big to cause plug to heat up, the protector may switch off and disconnect the electric connection between a live wire contact or neutral wire contact and a load wire, to block continual heating. When the heat is reduced, protector may be reset, and circuit may be reconnected. There may thus be no need to replace plug, which is convenient for use. In some embodiments, heat is transferred to bimetallic strip through pick to make bimetal strip expand and deform, and whole circuit may be disconnected by controlling a disconnection between pick and first contact or second contact. When bimetallic strip is cooled and resumed, pick may swing back to reconnect circuit.

Referring generally to FIGS. 1-4, in an exemplary embodiment a plug power cord includes a plug, a load wire 200 and a protector 300. Plug includes a main body 110, a live wire contact 121 and a neutral wire contact 122. Live wire contact 121 may be used to connect with a live wire of alternating current, and neutral wire contact 122 may be used to connect with a neutral wire of alternating current. Protector 300 may be connected between load wire 200 and live wire contact 121 or may be connected between the load wire 200 and the neutral wire contact 122.

In practice, when overload is too great, threatening to heat the plug up, protector 300 will switch off, disconnecting an electric connection between live wire contact 121 or neutral wire contact 122 and load wire 200, to block continual heating and prevent an electric appliance of load 500 from being damaged due to excessive current. When heat is reduced, protector 300 may be reset, where automatic reset or power off reset may be used to reset protector 300 and thus to reconnect circuit without the need of replacing plug, which is convenient for use.

Plug power cord in a first exemplary embodiment of present disclosure includes a plug, a load wire 200 and a protector 300. Plug includes a main body 110, a live wire contact 121 and a neutral wire contact 122. Live wire contact 121 may be used to connect with a live wire of alternating current, and neutral wire contact 122 may be used to connect with a neutral wire of alternating current. Protector 300 is connected between load wire 200 and live wire contact 121. Protector 300 includes first contact 310, second contact 320, pick 330 and bimetallic strip 340. First contact 310 electrically connected with live wire contact 121. Second contact 320 is connected with load wire 200. One end of the pick 330 is fixedly connected with first contact 310, and another end is electrically connected with second contact 320 and may be detachable from second contact 320 to disconnect circuit. Bimetallic strip 340 is stacked with pick 330; specifically, the bimetallic strip 340 may be arranged below the pick 330.

In practice, when alternating current (AC) from an external is input to plug increases the instantaneous current due to a fault as a short circuit occurring in a load circuit, pick 330 my generate heat, and the heat may be simultaneously conducted to bimetallic strip 340 to heat up the bimetallic strip 340; as an expansion degree for both sides of bimetallic strip 340 may not be consistent, the bimetallic strip 340 may deform and cause pick 330 to jack up. At this time, pick 330 may separate from second contact 320, to disconnect circuit and prevent plug from continually heating up. After disconnecting, bimetallic strip 340 may stop heating. After cooling, bimetallic strip 340 may resume contact; pick 330 may connect with second contact 320 again, and plug may be reinserted into the socket to resume use.

In some embodiments, protector 300 may be located within main body 110. Protector 300 may be integrated into plug to make the whole wire more compact.

In some embodiments, plug may also be provided with a ground contact 123, which may be connected to load wire 200. Plug may effectively prevent a user from getting an electric shock after connecting plug to ground wire.

In some embodiments, an exterior of protector 300 may be coated with a plastic layer 350; t plastic layer 350 may be able to prevent parts inside the protector 300 from being damaged and causing the protector 300 to fail.

In an embodiment, plug power cord may include a plug, a load wire 200 and a protector 300. Plug may include a main body 110, a live wire contact 121 and a neutral wire contact 122. Live wire contact 121 may be used to connect with a live wire of alternating current, and neutral wire contact 122 may be used to connect with a neutral wire of alternating current. Protector 300 is connected between load wire 200 and live wire contact 121. Protector 300 includes first contact 310, second contact 320, pick 330 and bimetallic strip 340; first contact 310 may be electrically connected with neutral wire contact 122, while second contact 320 may connected with load wire 200. One end of pick 330 may be fixedly connected with first contact 310, and another end may be electrically connected with second contact 320; other end may be detachable from the second contact 320 to disconnect the circuit. Bimetallic strip 340 may stacked with pick 330; specifically, bimetallic strip 340 may be arranged below pick 330.

In practice, when a surge in alternating current (AC) from the external is input to plug occurs, such due to a fault from a short circuit in a load circuit to increase instantaneous current, pick 330 may generate heat, and the heat may be simultaneously conducted to bimetallic strip 340 to heat up the bimetallic strip 340; as the expansion degree for both sides of the bimetallic strip is not consistent bimetallic strip 340 may deform and cause the pick 330 to jack up. As a result pick 330 may separate from second contact 320, disconnecting a circuit and prevent plug from continually heating. After disconnecting, bimetallic strip 340 may stop heating. After cooling, bimetallic strip 340 will resume. Pick 330 may connect with second contact 320 again, and plug may be reinserted into a socket to resume use.

In an embodiment, protector 300 may be located within main body 110. Protector 300 may integrated into plug to make the whole wire more compact.

In an embodiment, plug may also be provided with a ground contact 123, which may be connected with load wire 200. Plug may effectively prevent a user from getting an electric shock after connecting the plug to a ground wire.

In an embodiment, an exterior of protector 300 may be coated with a plastic layer 350. Plastic layer 350 may prevent parts inside the protector 300 from being damaged, which could cause the protector 300 to fail.

Figure 3:
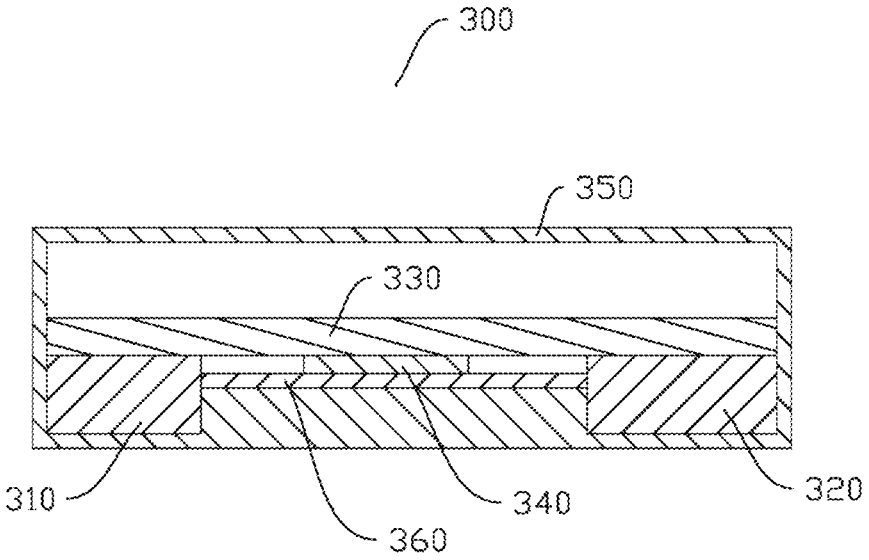
FIG. 3 is a cross-sectional view of a protector in embodiment 3 of the present disclosure.

As shown in FIG. 3, plug power cord in an embodiment may include a plug, a load wire 200 and a protector 300. Plug may include a main body 110, a live wire contact 121 and a neutral wire contact 122. Live wire contact 121 may be used to connect with a live wire of alternating current, and neutral wire contact 122 may be used to connect with a neutral wire of alternating current. Protector 300 may be connected between load wire 200 and live wire contact 121. Protector 300 may include a first contact 310, a second contact 320, a pick 330, a positive temperature coefficient (PTC) chip 360 and a bimetallic strip 340. First contact 310 may be connected with a neutral wire contact 122 Second contact 320 may be connected with load wire 200. One end pick 330 may be fixedly connected with first contact 310; another end may be electrically connected with second contact 320 and may be detachable from the second contact 320 to disconnect the circuit. A resistance of PTC chip 360 may be greater than that of pick. Two ends of PTC chip 360 may be respectively connected to first contact and second contact. PTC chip 360, bimetallic strip 340 and pick 330 may be stacked from bottom to top.

Heat may be conducted to bimetallic strip 340 via pick 330, to make bimetallic strip 340 expand and deform; the pick 330 may be disconnected from first contact 310 so that the whole circuit is disconnected. At this point, PTC chip 360 may start to power up and heat up, and constantly heat bimetallic strip; if plug is pulled out of a socket in which it is plugged, this may disconnect the circuit of PTC chip 360 to cool the bimetallic strip, causing pick to swing back to reconnect with first contact or second contact. This may be done manually to further increase security.

In an embodiment, protector 300 may also be arranged on load wire 200, with two ends of protector arranged on the load wire 200. Through load wire 200, protector 300 may electrically connect with live wire contact 121 or neutral contact 122.

Figure 4:
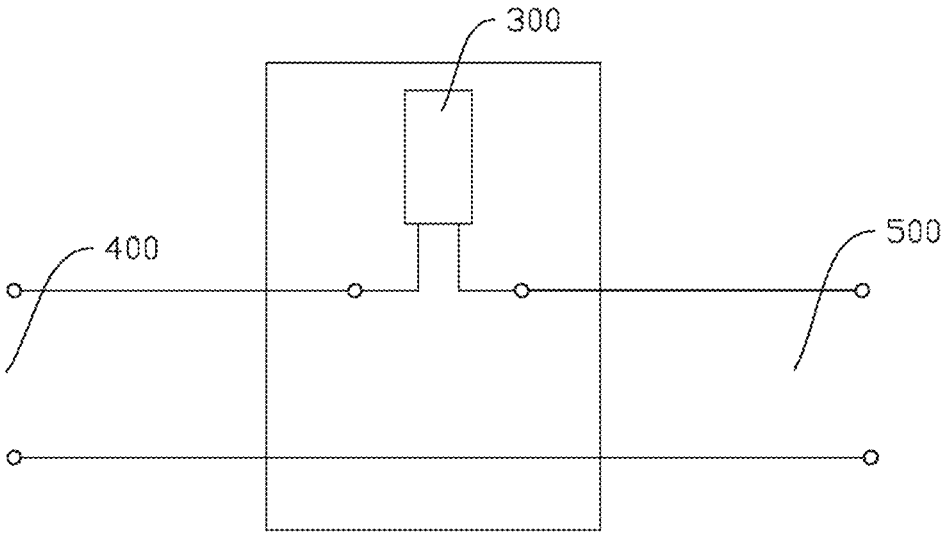
FIG. 4 is a circuit diagram of a plug power cord connected to a circuit of an embodiment of the present disclosure.

Referring to FIG. 4, an exemplary embodiment of a working connection circuit of plug power cord of an embodiment of the present disclosure is illustrated. A protector 300 may be arranged in a plug, with two ends of plug power cord connected with AC power 400 and a load 500.

With protection of protector 300, plug mat be prevented from being damaged due to excessive heat or excessive load current.

The above embodiments of the present disclosure are explained in detail in combination with the attached figures. However, the present disclosure is not limited to the above embodiments, and within the scope of knowledge possessed by those skilled in the art, various changes can also be made without departing from the purpose of the present disclosure.

What is claimed is:

1. A plug power cord, comprising:

a plug, the plug comprising a main body, a live wire contact and a neutral wire contact;

a load wire, wherein the load wire is connected with at least one of the live wire contact and the neutral wire contact; and a protector, the protector arranged between the load wire and the at least one of the live wire contact and the neutral wire contact to which the load wire is connected, wherein an exterior of the protector is covered with a plastic layer that is separate from the main body of the plug.

2. The plug power cord of claim 1, wherein the protector comprises:

a first contact connected with at least one of the live wire contact and the neutral wire contact;

a second contact connected with the load wire;

a pick having one end fixedly connected to the first contact and the other end capable of being disconnected from or connected to the second contact; and a bimetallic strip stacked with the pick;

wherein the bimetallic strip is configured to expand, resulting in disconnection between the pick and the second contact.

3. The plug power cord of claim 2, wherein the exterior of the protector is coated with the plastic layer.

4. The plug power cord of claim 1, wherein the protector comprises:

a first contact connected with at least one of the live wire contact and the neutral wire contact;

a second contact connected with the load wire;

a pick having one end fixedly connected to the second contact and the other end capable of being disconnected from or connected to the first contact; and a bimetallic strip stacked with the pick;

wherein the bimetallic strip is configured to expand, resulting in disconnection between the pick and the first contact.

5. The plug power cord of claim 1, wherein the protector comprises:

a first contact connected with at least one of the live wire contact or the neutral wire contact;

a second contact connected with the load wire;

a pick having one end fixedly connected to the first contact and the other end capable of being disconnected from or connected to the second contact;

a positive temperature coefficient (PTC) chip, wherein a resistance of the PTC chip is greater than that of the pick, and both ends of the PTC chip are respectively connected to the first contact and the second contact; and a bimetallic strip stacked with the pick and the PTC chip;

wherein the bimetallic strip is configured to expand, resulting in disconnection between the pick and the second contact.

6. The plug power cord of claim 1, wherein the protector comprises:

a first contact connected with at least one of the live wire contact or the neutral wire contact;

a second contact connected with the load wire;

a pick having one end fixedly connected to the second contact and the other end capable of being disconnected from or connected to the first contact;

a positive temperature coefficient (PTC) chip, wherein a resistance of the PTC chip is greater than that of the pick, and both ends of the PTC chip are respectively connected to the first contact and the second contact; and a bimetallic strip stacked with the pick and the PTC chip;

wherein the bimetallic strip is configured to expand, resulting in disconnection between the pick and the second contact.

7. The plug power cord of claim 1, wherein the protector is arranged inside the main body.

8. The plug power cord of claim 1, wherein the protector further comprises a ground wire contact connected with the load wire.

9. The plug power cord of claim 1, wherein the exterior of the protector is coated with the plastic layer.

10. A plug power cord, comprising:

a plug, the plug comprising a main body, a live wire contact and a neutral wire contact;

a load wire, wherein the load wire is connected with at least one of the live wire contact and the neutral wire contact; and a protector, the protector arranged between the load wire and the at least one of the live wire contact and the neutral wire contact to which the load wire is connected, wherein the protector comprises:

a first contact connected with at least one of the live wire contact and the neutral wire contact;

a second contact connected with the load wire;

a pick having one end fixedly connected to the first contact and the other end capable of being disconnected from or connected to the second contact; and a bimetallic strip stacked with the pick;

wherein the bimetallic strip is configured to expand, resulting in disconnection between the pick and the second contact.

11. The plug power cord of claim 10, wherein the protector further comprises a positive temperature coefficient (PTC) chip, wherein a resistance of the PTC chip is greater than that of the pick, and both ends of the PTC chip are respectively connected to the first contact and the second contact.

12. The plug power cord of claim 11, wherein the bimetallic strip is stacked with the PTC chip.

13. The plug power cord of claim 10, wherein the protector is arranged inside the main body.

14. The plug power cord of claim 10, wherein the protector further comprises a ground wire contact connected with the load wire.

15. A plug power cord, comprising:

a plug, the plug comprising a main body, a live wire contact and a neutral wire contact;

a load wire, wherein the load wire is connected with at least one of the live wire contact and the neutral wire contact; and a protector, the protector arranged between the load wire and the at least one of the live wire contact and the neutral wire contact to which the load wire is connected, wherein the protector comprises:

a first contact connected with at least one of the live wire contact and the neutral wire contact;

a second contact connected with the load wire;

a pick having one end fixedly connected to the second contact and the other end capable of being disconnected from or connected to the first contact; and a bimetallic strip stacked with the pick;

wherein the bimetallic strip is configured to expand, resulting in disconnection between the pick and the first contact.

16. The plug power cord of claim 15, wherein the protector further comprises a positive temperature coefficient (PTC) chip, wherein a resistance of the PTC chip is greater than that of the pick, and both ends of the PTC chip are respectively connected to the first contact and the second contact.

17. The plug power cord of claim 16, wherein the bimetallic strip is stacked with the PTC chip.

18. The plug power cord of claim 15, wherein the protector is arranged inside the main body.

19. The plug power cord of claim 15, wherein the protector further comprises a ground wire contact connected with the load wire.

* * * * *